US005516112A

United States Patent [19]

Rypinski

[11] Patent Number: 5,516,112

[45] Date of Patent: May 14, 1996

[54] GAME FRAME

[75] Inventor: Alan Rypinski, Newport Beach, Calif.

[73] Assignee: Pog Unlimited, Costa Mesa, Calif.

[21] Appl. No.: 326,911

[22] Filed: Oct. 21, 1994

[51] Int. Cl.[6] ..... A63F 3/00

[52] U.S. Cl. ..... 273/287; 273/309; D21/14

[58] Field of Search ..... 273/309, 287, 273/274, 272, 261, 108, 118 R; D21/17, 14, 20, 37

[56] References Cited

U.S. PATENT DOCUMENTS

| | | | |
|---|---|---|---|
| D. 128,163 | 7/1941 | Greitzer | D21/37 |
| D. 161,845 | 2/1951 | Larson | D21/37 |
| 1,655,607 | 1/1928 | Hueter | 273/309 |
| 1,970,877 | 8/1934 | Anderson | 273/309 |

FOREIGN PATENT DOCUMENTS

| | | | |
|---|---|---|---|
| 2055299 | 3/1981 | United Kingdom | 273/309 |

*Primary Examiner*—Benjamin H. Layno

*Attorney, Agent, or Firm*—Ladas & Parry

[57] ABSTRACT

A a game frame for playing the game POGs (tm). The game frame has a uniform, consistent playing surface for the play of the game, as well as separate peripheral storage space for playing pieces or discs for each of the players. The game frame also provides for the removable installation of interchangeable mats or pads in the center thereof, to provide surfaces of different resilience as desired. The game frame is used by stacking a plurality of the playing pieces or discs in the center thereof, and using a "slammer" playing pieces or disc (also called a "kini" or "hitter") to hit the stack and attempt to cause at least some of the stacked playing pieces or discs to be flipped over. Playing piece which are flipped over are kept by the player, with the player acquiring the greatest number of playing pieces (or those having the greatest value, in some variations) being the winner. As the game is to a certain extent dependent upon the surface upon which it is played, the present game board provides for consistency in the play of the game to eliminate variations in the playing surface which could lead to inconsistent scoring.

12 Claims, 2 Drawing Sheets

FIG. 1
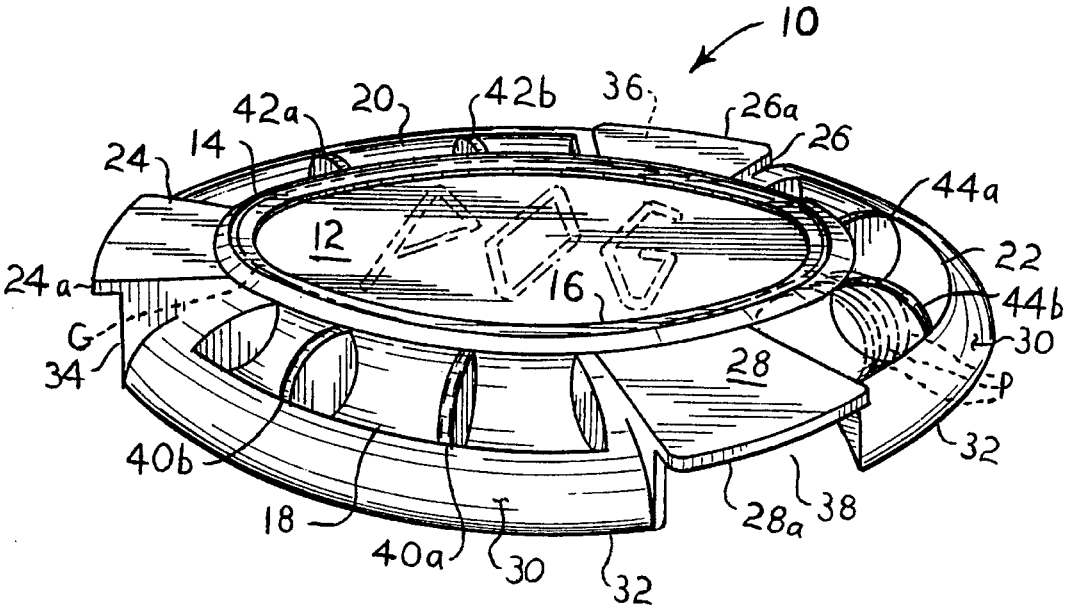
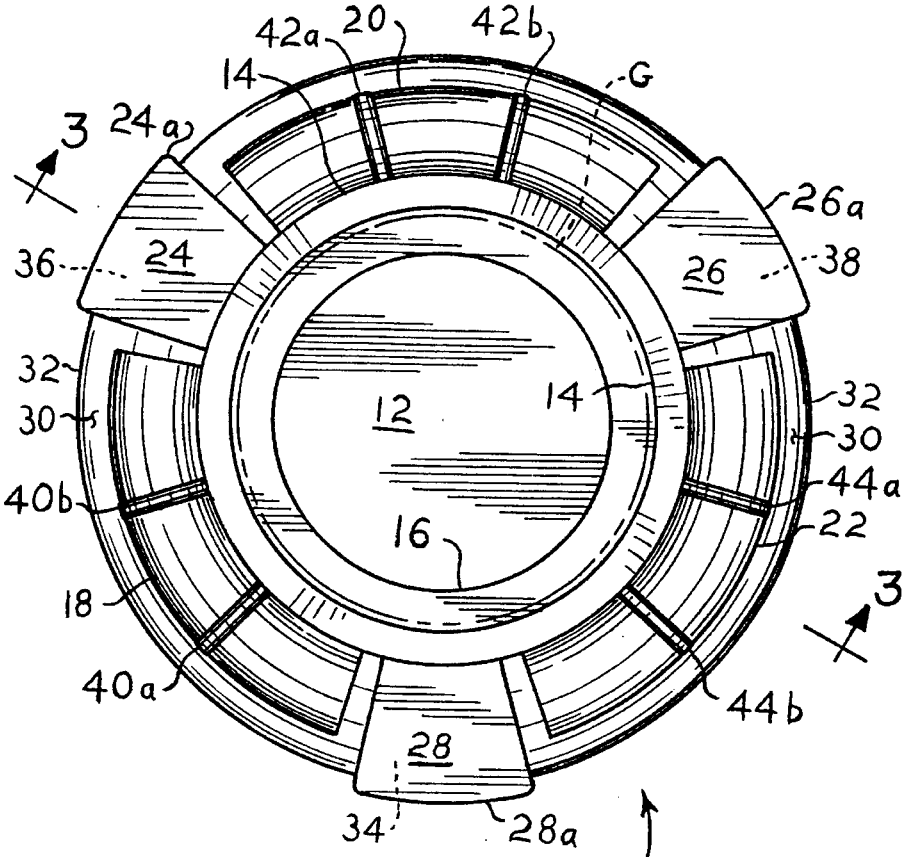
FIG. 2

GAME FRAME

FIELD OF THE INVENTION

The present invention relates generally to game boards or devices providing for the play of a game thereon, and more specifically to a frame including a central area for the placement of a game pad therein and peripheral areas for the storage of playing pieces discs used in the play of the game.

BACKGROUND OF THE INVENTION

Playing pieces or discs known as POGs™ originated in Hawaii in the 1920's as waxed or plasticized thin cardboard or paper caps or covers, used to seal the tops of glass beverage containers. These caps originally used to seal bottles containing a mixture of tropical fruit juices, comprising passionfruit, orange, and guava juices. The first letters (P, O, G) of the fruit juices were printed on the caps, which came to be known by the resulting acronym, "POG."

Children soon discovered that the caps could be used as playing pieces to play a relatively simple known as POGs™ game, bearing a slight resemblance to a combination of the games of marbles and tiddly winks. In the game, the playing piece are stacked face up, and another playing piece (developed as a heavier type of playing pieces or disc) is thrown at the a stack of discs or playing pieces to cause the playing pieces or discs of the stack to scatter, in an attempt to cause at least some of the discs to flip over or invert. The player causing the playing pieces or discs to flip over, is generally allowed to keep those discs as winnings, at least for the course of the game. Numerous variations are known, including scoring according to different numerical values printed on the backs of the playing pieces or discs and exposed when they are flipped over, etc.

The game has been popular in Hawaii at various times since the 1920s, and in fact has resulted in the manufacture of-myriads of specially formed and printed discs for collectors and players of the game. Some of the originally manufactured playing pieces or discs and some relatively rare specially printed playing pieces or discs are considered to be worth a fairly substantial sum by collectors and devotees of the game and collecting hobby.

Nevertheless, even though the game has been extremely popular at various times, it has traditionally been played upon any convenient surface, with no formalized playing board or area used. Table tops, floors, sidewalks, paved parking lots, dirt paths or fields, etc., have all been used to play this game. With the following, the game has developed, many players have developed relatively high skills in the throwing of the heavier playing piece or disc known as the "kini," "hitter," or "slammer" disc. It will be readily seen that the variety of surfaces generally used in the play of the game, will result in inconsistent scoring, even by experts at the game.

Accordingly, the need arises for a a game frame which provides for a uniform playing surface, as well as providing for the storage game pieces used in the play of the game and won during the course of play. Storage of "slammer" discs may also be provided. Plural separate storage areas for the playing pieces of different players should be an integral part of the game frame, and preferably the playing surface used to "slam" the player piece stack is interchangeable, to provide different characteristics and degrees of difficulty in achieving the desired player piece inversion rate, as desired by the players. Finally, the game frame should be relatively inexpensive to manufacture and therefore to purchase, in keeping with the simple and basic spirit of the game.

DESCRIPTION OF THE PRIOR ART

U.S. Pat. No. 5,069,459 issued to Sandor J. Zarnoti on Dec. 3, 1991 discloses a Game Apparatus And Method including a generally circular tray including a plurality of radially disposed slots therein, each providing for the containment of a single disc. A plurality of generally horizontal single disc storage areas is also provided, alternating with the slots. The resulting storage space is limited, whereas the present game frame provides edgewise storage space for numerous player pieces around the periphery of the board. More importantly, the center of the Zarnoti device cannot provide a smooth, level surface for the placement of playing pieces or discs thereon, as it includes a plurality of radial grooves extending outwardly from a single central disc recess.

U.S. Pat. No. 5,184,829 issued to Dim Njaka on Feb. 9, 1993 discloses a Game Apparatus And Method including a round tray having a plurality of concave depressions formed about the periphery. The center area is divided by four walls to form four receptacles for holding removable shells or cups therein. The configuration of the Njaka apparatus does not allow the edgewise stacking of discs therein, nor does it provide a smooth, flat central area for play.

U.S. Pat. No. Des. 139,868 issued to Chester T. Knobloch on Jan. 2, 1945 discloses a design for a Game Board having a plurality of relatively small, round and shallow depressions peripherally disposed, and a series of radially disposed shallow slots. No means is provided for the storage or placement of circular discs or playing pieces therein, nor for interchangeable central playing surfaces, as provided by the present game frame.

U.S. Pat. No. 217,973 issued to Frank Kohner et al. on Jul. 7, 1970 discloses a design for a Game Board of generally circular configuration. The central depression is not flat and cannot be used for the stacking of player pieces or discs therein, nor is any storage for player pieces or discs provided, as in the present board.

U.S. Pat. No. Des. 246,609 issued to Hideyaki Kanno on Dec. 6, 1977 discloses a design for a Game Board having four levers extending upwardly from the four corners thereof, and an offset central knob. The levers and knobs preclude the stacking of player pieces discs thereon or the storage of such playing pieces or discs on the board, and further impede the tossing of a "kini,""hitter," or "slammer" piece at the center of the board.

U.S. Pat. No. Des. 279,801 issued to Joseph M. Brockenshire on Jul. 23, 1985 discloses a design for a Card Table Top having a flat center and a plurality of variously shaped depressions around the octagonal periphery. The depressions do not provide for the storage or stacking of any disc shaped articles or player pieces therein.

U.S. Pat. No. Des. 324,887 issued to Rudolph F. Cecalek on Mar. 24, 1992 discloses a design for a Game Board having a slightly concave central area with a plurality of relatively small depressions formed therearound. The curved central area cannot be used for the stacking of player pieces or discs therein due to its non-level surface, and the periphery provides no storage for the stacking or other placement of player pieces or discs.

U.S. Pat. No. Des. 331,607 issued to Sean J. Davis on Dec. 8, 1992 discloses a design for a Dice Game Accessory including a round, flat central area and a raised periphery.

However, the Davis device fails to provide for the storage or stacking of discs or player pieces about the periphery, as provided by the present game frame.

Finally, U.S. Pat. No. Des. 339,172 issued to Kent Roberts et al. on Sep. 7, 1993 discloses a Floating Hot Tub Game Table including a square central depression and a plurality of variously shaped depressions about the periphery. The peripheral depressions cannot provide for the storage or placement of player pieces or discs therein or thereon, and the buoyant nature of the Roberts et al. device results in a relatively bulky configuration unlike the present game frame.

None of the above-noted patents, taken either singly or in combination, are seen to disclose the specific arrangement of concepts disclosed by the present invention.

SUMMARY OF THE INVENTION

By the present invention, an different game frame is disclosed.

Accordingly, one of the inventor's desires in creating the present invention is to provide an different game frame which provides a standardized level playing surface for the stacking of playing pieces or discs thereon, for the play of the game.

Another of the inventor's desires in creating of the present invention is to provide an different game frame which includes means providing for the interchangeability of different playing surfaces having different resilience, as desired.

Yet another of the inventor's desires in creating the present invention is to provide an different game frame which includes means for the separate storage of playing pieces or discs for plural players of the game, as well as for convenient placement of a "kini," "hitter," or "slammer" player piece or disc for ready access thereto as required for a player's turn.

Still another of the inventor's desires in creating the present invention is to provide an different game frame which includes means to facilitate the grasping or picking up of the game board by peripheral flats extending therefrom, which flats may also serve as storage areas for the stacking of player pieces or discs not in play.

A further desire of the inventor in creating the present invention is to provide an different game frame which may be readily formed from a variety of materials and using a variety of methods, such as injection molding from plastic.

A final object of the present invention is to provide an improved pog game board for the purposes described which is inexpensive, dependable and fully effective in accomplishing its intended purpose.

Unique aspects of this invention will become apparent in the following description setting forth the combination and arrangement of parts hereinafter more fully described, illustrated and claimed with reference being made to the attached drawings.

BRIEF DESCRIPTION OF THE DRAWINGS

FIG. 1 is a perspective view of the present frame, showing its general features and use.

FIG. 2 is a top plan view of the present frame, showing further details.

Similar reference characters denote corresponding features consistently throughout the several figures of the attached drawings.

DETAILED DESCRIPTION OF THE PREFERRED EMBODIMENT

Figure 3:
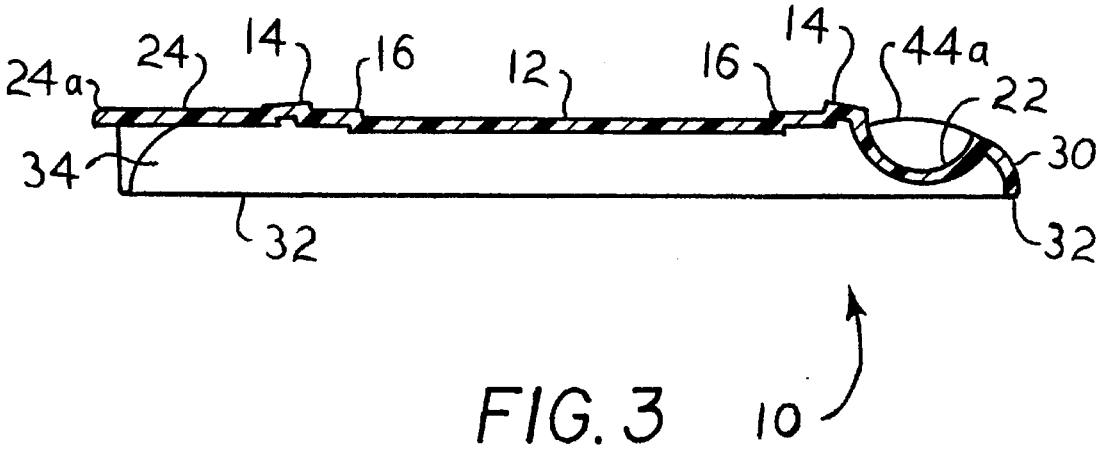
FIG. 3 is a side elevation view in section along line 3—3 of FIG. 2, and showing further details.

Referring now particularly to FIG. 1 of the drawings, the present invention will be seen to relate to a game frame 10, providing numerous advantages and consistency in the play of the game. The game board 10 includes a circular, flat and level central playing area 12 surrounded by a relatively higher, raised circumferential playing area periphery 14. A step 16 may be provided at an intermediate height between the central playing area 12 and the playing area periphery 14, if desired. The central playing area provides for the removable installation of a game pad G therein, with the step 16 providing for the slight lifting or raising of the outer edge of the game pad G relative to the central playing area 12. Thus, various game pads G having different resilience may be removably placed within the playing area periphery 14, to provide resilience characteristics as desired for the play of the game.

The playing area 12 and playing area periphery 14 are in turn surrounded by a generally circumferential concave area, divided into a plurality (e.g., three) semicircumferential storage areas 18, 20, and 22 adapted for the edgewise storage of discs P therein. The storage areas 18, 20, and 22 each have a generally semicircular cross section (shown in FIG. 3), to closely fit the circular shape of any P which may be stored therein. Each of the storage areas 18, 20, and 22 are preferably positioned slightly lower than the central playing area 12, as shown in the cross sectional view of FIG. 3 through line 3—3 of FIG. 2, in order to preclude any significant obstruction of the playing area 12 by discs P stored within the storage areas 18, 20, and 22.

The storage areas 18, 20, and 22 are in turn surrounded by an outer rim 30 having a convex curvature, and extending downwardly and outwardly from the storage areas 18, 20, and 22 to an outer, lower rim edge 32. Each of the storage areas 18, 20, and 22 are separated from one another by an equal number of flat, level extensions 24, 26, and 28 extending outwardly from the central playing area periphery 14, and respectively positioned between each of the storage areas 18, 20, and 22. Each of the extensions 24, 26, and 28 include a respective opening 34, 36, and 38 thereunder, which openings 34, 36, and 38 serve to divide the outer rim 30 into a plurality of segments equal to the number of extensions. The openings 34, 36, and 38 beneath the respective extensions 24, 26, and 28 provide for the insertion of the fingers of the hand thereunder, whereby the game board may be grasped, lifted, and/or manipulated by grasping the appropriate extension 24, 26, and/or 28. Each of the extensions 24, 26, and 28 also preferably respectively includes a lip 24*a*, 26*a*, and 28*a*, which lips extend at least somewhat beyond the circumference of the game board 10 defined by the outer and lower rim edge 32 to provide further ease of manipulating the game board 10.

The storage areas 18, 20, and 22 are preferably further divided into a plurality of separate storage sections by a number of radially disposed, vertical storage area dividers 40*a* and 40*b* (for storage area 18), 42*a* and 42*b* (for storage area 20), and 44*a* and 44*b* (for storage area 22). The dividers are preferably provided with smoothly rounded upper edges to blend with the convex curvature of the outer rim 30. More or fewer dividers may be provided as desired, rather than the two dividers forming three separate sections for each of the storage areas 18, 20, and 22.

The plan view of FIG. 2 discloses that the three storage areas 18, 20, and 22 are each of equal circumferential length, and each subtend an equal arcuate angle of the game board 10. In a like manner, preferably the two dividers 40*a* and 40*b* (for storage area 18), 42*a* and 42*b* (for storage area 20), and 44*a* and 44*b* (for storage area 22) divide each of the storage areas 18, 20, and 22 into three equal sections. However, it will be understood that more or fewer storage areas of equal or unequal size may be provided by varying the number of extensions therebetween, and in a like manner, more or fewer sections in any one or more of the storage areas may be provided by varying the number and/or positioning of dividers in the appropriate storage area(s), as desired.

The present game frame 10 lends itself to construction. from a variety of materials and methods. Preferably, the game frame 10 is formed of plastic material using injection molding or other suitable fabrication means, however other materials (e.g., metals such as aluminum, etc.) and fabrication methods (e.g., casting, etc.), may be used if desired. Construction of the present frame 10 of molded plastic results in a game board 10 formed as a single, monolithic unit of only one piece, thus providing for durability and economy of construction and purchase.

The present game frame 10 is used by placing a game pad G of the desired resilience in the center area 12 of the frame 10, with each player preferably providing an equal number of discs P to form a single stack generally on the game pad G in the center of the central area 12. (Alternatively, the present game frame 10 may be used without a game pad G, if desired, to provide a firmer surface.) Additional discs P may be stored in each storage area as desired by the players. (The present game board 10 is configured for three players. However, it will be understood that more or fewer storage areas, and/or sections of those storage areas, may be provided without departing from the spirit of the present invention.) Discs or player pieces P won during the course of play may be placed in the appropriate player's storage area, as desired. When the game is over, the game frame 10 may be retrieved from the playing site by lifting or handling by means of the extensions thereon, which extensions further provide for decorative logos and/or indicia (not shown), if desired. Thus, the present game frame 10 provides a standardized playing surface and device for playing playing a game, and serves to eliminate inconsistencies in the underlying playing surface as well as providing for uniform placement of game pads of different resiliencies thereon, as desired.

It is to be understood that the present invention is not limited to the sole embodiment described above, but encompasses any and all embodiments within the scope of the following claims.

I claim:

1. A game frame comprising:

a generally circular frame having a flat, circular level central playing area adapted for the stacking of playing pieces thereon and surrounded by a raised circular playing area periphery that does not obstruct the view of the playing area for playing thereon;

a plurality of semicircular storage areas surrounding said central playing area and said raised playing area periphery, each of said storage areas having a concave generally semicircular cross section adapted for the edgewise storage of a plurality of playing pieces therein, said storage areas being surrounded by a downwardly and outwardly disposed outer rim having a convex curvature, said outer rim defining the periphery of said circular frame;

said storage areas each being separated by a flat, level extension extending from said central playing area periphery, disposed between each of said storage areas and radially outwardly across said outer rim beyond the periphery of the circular frame, whereby;

said storage areas are used by players for the storage of their respective playing pieces during the play of a game using said frame, and said central playing area is used for the stacking of playing pieces thereon during the course of play and provides a consistent playing surface for the play of the game.

2. The game frame of claim 1 further comprising: removable game pads, each pad having different characteristics and resilience, said central playing area and surrounding raised playing area periphery comprises means providing for the interchangeable installation of said pads therein, as desired, whereby;

said game pads are removably installable on said playing area to provide different levels of challenge for the players as desired.

3. The game frame of claim 1 wherein: each of said storage areas is of generally equal size and subtends an equal arcuate angle about said playing area.

4. The game frame of claim 1 wherein: said game frame includes three storage areas and three extensions alternately spaced between said areas.

5. The game frame of claim 1 wherein: each of said storage areas includes a plurality of dividers radially disposed thereacross, with each of said dividers comprising a vertical wall providing for the separation of sections of each of said storage areas.

6. The game frame of claim 1 wherein: each of said storage areas is divided to provide three storage sections in each of said areas.

7. The game frame of claim 1 wherein: said storage areas are disposed below said central playing area and said playing area periphery, whereby obstruction of said central playing area is precluded.

8. The game frame of claim 1 wherein: each said extension includes an opening thereunder and through said outer rim interrupting the convex curvature of said outer rim, with each said extension and each said opening thereunder providing gripping means for the handling of said game frame.

9. The game frame of claim 1 wherein: said game frame is formed as a single unitary piece.

10. The game frame of claim 1 wherein: said game frame is formed of plastic material.

11. A game frame comprising:

a generally circular frame having a flat, circular and generally level central playing area adapted for the stacking of playing pieces thereon and surrounded by a raised playing area periphery that does not obstruct the view of the playing area during play thereon;

a plurality of semicircular storage areas surrounding said central playing area and said raised playing area periphery, each of said storage areas having a concave generally semicircular cross section adapted for the edgewise storage of a plurality of playing pieces therein without obstruction of the playing surface, and a downwardly and outwardly disposed outer rim having a convex curvature, each of said storage areas being of generally equal size and subtending a generally equal arcuate angle about said playing area, said storage areas including a plurality of dividers radially disposed thereacross, with each of said dividers comprising a vertical wall providing for the separation of sections of each of said storage areas, said storage areas each being separated by a flat, level extension, said extension extending from said central playing area periphery and being disposed between each of said storage areas and radially outwardly across said outer rim, said storage areas being disposed below said central playing area and said playing area periphery whereby obstruction of said central playing area is precluded, each said extension defining an opening thereunder and through said outer rim, with each said extension and each said opening thereunder providing gripping means for the easy lifting and moving of said game frame, said storage areas being used by players for the storage of their respective playing pieces during the play of a game using said frame, said central playing area being used for the stacking of playing pieces thereon during the course of play and providing a generally consistent playing surface for the play of the game; and removable game pads having different characteristics and resilience, said central playing area and surrounding raised playing area periphery comprising means enabling the interchangeable installation of said pads therein, said game pads being removably installable on said playing area to provide different levels of challenge for the players as desired.

12. A light weight, and generally circular game frame for use with playing pieces, said frame comprising:

a generally circular and level central playing area;

a raised periphery surrounding but not obstructing said playing area for play thereon;

a plurality of storage areas surrounding said raised periphery and shaped for receipt of said playing pieces without obstruction of said central playing area, said storage areas being positioned below said playing area;

extensions extending from said periphery and between said storage areas and defining gripping means to enable one to easily move and place said game frame; and removable game pads for placement on said playing surface when desired, said pads being of similar diameter to that of said playing area for fitting within said periphery and on said frame, each of said game pads differing in resilience from each other and from said playing area to provide varying and selectable resilience characteristics.

* * * * *